United States Patent [19]

Henry

[11] Patent Number: 4,525,663

[45] Date of Patent: Jun. 25, 1985

[54] PRECISION BAND-GAP VOLTAGE REFERENCE CIRCUIT

[75] Inventor: Paul M. Henry, Tucson, Ariz.

[73] Assignee: Burr-Brown Corporation, Tucson, Ariz.

[21] Appl. No.: 404,821

[22] Filed: Aug. 3, 1982

[51] Int. Cl.[3] ..... G05F 1/56

[52] U.S. Cl. ..... 323/280; 323/281; 323/313; 323/315; 330/257

[58] Field of Search ..... 323/273, 280, 281, 313, 323/314, 315, 907; 330/257, 260

[56] References Cited

U.S. PATENT DOCUMENTS

| | | | |
|---|---|---|---|
| 3,617,859 | 11/1971 | Dobkin | 323/313 |
| 3,872,323 | 3/1975 | Federiksen et al. | 330/257 |
| 3,932,768 | 1/1976 | Takahashi et al. | 323/315 |
| 4,042,886 | 8/1977 | Hanna | 330/260 |
| 4,088,941 | 5/1978 | Wheatley | 323/313 |
| 4,095,164 | 6/1978 | Ahmed | 323/280 |
| 4,326,135 | 4/1982 | Jarrett et al. | 330/257 |
| 4,348,633 | 9/1982 | Davis | 323/907 |
| 4,366,445 | 12/1982 | Cave et al. | 330/257 |
| 4,396,883 | 8/1983 | Holloway et al. | 323/281 |

FOREIGN PATENT DOCUMENTS

| | | | |
|---|---|---|---|
| 5364 | 1/1979 | Japan | 330/257 |

*Primary Examiner*—William H. Beha, Jr.
*Attorney, Agent, or Firm*—Weiss & Holloway

[57] ABSTRACT

A band-gap voltage reference circuit which incorporates a band-gap differential amplifier supplied with constant, temperature-independent current, a high gain differential-to-single-ended converter, temperature-compensated negative feedback means and a common source of biasing to serve as a device to provide an output reference voltage so that the output reference voltage is precise and independent of variations in temperature, loading and power supply voltage. An improved amplifier is also disclosed.

36 Claims, 5 Drawing Figures

PRECISION BAND-GAP VOLTAGE REFERENCE CIRCUIT

BACKGROUND OF THE INVENTION

1. Field of the Invention

This invention generally relates to solid-state band-gap voltage reference circuits for providing an output voltage which is substantially constant with changes in temperature, and more specifically to an improved band-gap reference circuit in which temperature-compensation means operating at a constant current over the temperature range is provided to minimize changes in output voltage with changes in temperature. The invention also relates to improved circuitry for amplifiers having high gain characteristics.

2. Description of the Prior Art

In the past, Integrated Circuit (IC) band-gap reference circuits were constructed so as to pass unequal currents through a monolithically matched pair of transistor emitter-base junctions, or equal currents through unequal-area transistor emitter-base junctions, so as to obtain precisely defined differences in the characteristic band-gap voltages across the pair of junctions, and to derive therefrom a proportional voltage for use as a precision reference voltage. Such prior art, for example, is described in U.S. Pat. No. 3,617,859 (Dobkin, et. al. inventors) No. 3,887,863 (Brokaw inventor), and No. 4,250,445 (Brokaw inventor). The basic band-gap reference circuits of the prior art were relatively unsophisticated and large, complex, additional bias networks, current sources and loads were required in order for proper operation thereof.

Some of these prior-art circuits used passive loads and did not have sufficient open-loop voltage gain to provide a constant output voltage independent of temperature. These prior art circuits sometimes required cumbersome biasing circuitry. To use passive loads at low currents, resistors having large absolute values were required, thereby occupying unnecessarily large chip areas or semiconductor real estate. Because of relatively low loop gain in prior art band-gap voltage reference circuits, output voltage constancy as output load current varied (load rejection) was low.

Prior art band-gap voltage reference circuits generally employed a current through the band-gap transistor cell (or transistor pair) which was proportional to the ambient or semiconductor chip temperature.

A need existed for an improved band-gap voltage reference circuit in which the band-gap cell is biased at constant current throughout the temperature range, thereby improving temperature performance and saving power at high temperatures.

A need also existed for an improved band-gap voltage reference circuit whose complexity, device count and semiconductor area consumption for resistor devices would be low, so as to reduce the amount of semiconductor real estate or Integrated Circuit Chip area consumed.

A need further existed for an improved band-gap voltage reference circuit wherein the gain enclosed within a feedback loop was sufficiently high to improve constancy of output voltage despite variations in load current, supply voltage, ambient or chip temperature.

A need also existed for providing an improved amplifier having high gain characteristics and reduced device usage.

SUMMARY OF THE INVENTION

Figure 1:
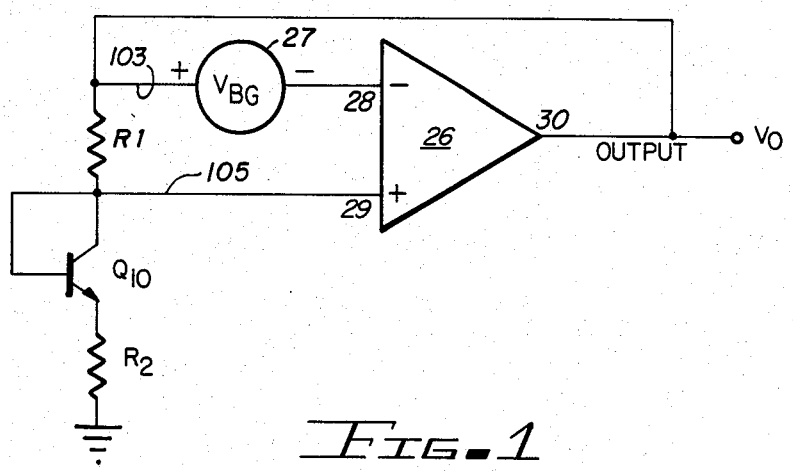
FIG. 1 is a simplified schematic diagram of the improved band-gap voltage reference circuit of this invention including a negative feedback loop.

In accordance with one embodiment of this invention, it is an object of this invention to provide an improved band-gap voltage reference circuit in which the band-gap cell is biased at constant current throughout the temperature range.

It is another object of this invention to provide an improved band-gap voltage reference circuit which improves the constancy of output reference voltage as the temperature varies.

It is yet another object of this invention to provide an improved band-gap voltage reference circuit having reduced power consumption and reduced on-chip power dissipation as the temperature varies.

It is a further object of this invention to provide an improved high gain amplifier.

It is still another object of this invention to provide an improved band-gap voltage reference circuit having reduced circuit complexity and reduced semiconductor real estate or integrated-circuit chip area usage.

Yet another object of this invention is to provide an improved band-gap voltage reference circuit which improves the constancy of the output reference voltage as the load current varies.

Still another object of this invention is to provide an improved band-gap voltage reference circuit which reduces the sensitivity of the reference output voltage as the supply voltage varies.

DESCRIPTION OF THE PREFERRED EMBODIMENTS

In accordance with one embodiment of this invention, a band-gap voltage reference circuit is disclosed which comprises a differential amplifier wherein two emitter-coupled bipolar transistors operate at different emitter current densities, and wherein the differential base input voltage, in equilibrium, equals the difference in the characteristic "band-gap" voltage of the two respective emitter-base junctions (of the two emitter-coupled transistors) arising from the differences in the emitter current densities. A temperature-independent current sink forces the total emitter current from the said emitter-coupled pair of transistors to remain constant, in order to improve the temperature stability of the "band-gap" voltage difference. The differential output current of the differential amplifier is converted and amplified to a single-ended current, which is buffered to drive an output load. A current source derived from the same biasing circuitry as that which sets the current of the current sink, supplies a constant, temperature-independent current for the operation of the differential-to-single-ended converter. A feedback network is provided which applies a differential, temperature-compensated, scaled replica of the output voltage impressed across the load to the differential inputs of the differential amplifier, thereby resulting in an equilibrium wherein the output voltage is a scaled, temperature-compensated replica of the precisely predictable "band-gap" difference voltage.

In accordance with another embodiment of this invention as generally described above in the first embodiment, an improved band-gap voltage reference circuit is provided wherein the difference in emitter current densities in the differential amplifier is achieved by passing equal currents through two emitter-coupled transistors having unequal and precisely ratioed emitter areas, and the differential-to-single-ended conversion means operates at equilibrium when differential-amplifier output currents are equal.

In accordance with yet another embodiment of this invention as generally described above in the first embodiment, an improved band-gap voltage reference circuit is provided wherein the difference in emitter current densities in the differential amplifier is achieved by passing unequal currents through two emitter-coupled transistors having equal emitter areas, and the differential-to-single-ended conversion means operates at equilibrium when differential-amplifier output currents are unequal by a precise ratio defined by the conversion means.

In each of the foregoing embodiments, the improved band-gap reference circuits permit reduced circuit complexity, size and power consumption by providing a single biasing means which provides precise, temperature-compensated biasing.

In each of the foregoing embodiments, the improved band-gap reference circuits permit conversion of the differential output current of the differential amplifier into a single-ended current which is accomplished by "mirroring" means augmented by an added common-collector transistor, which provides added gain and reduced sensitivity to load impedance variations.

In each of the foregoing embodiments, the improved band-gap voltage reference circuits provide temperature compensation of the feedback network which is accomplished by placing a diode-connected transistor, having a negative temperature coefficient, in series with feedback divider resistors. The current is forced through these feedback divider resistors by an output buffer.

In all of the above generally described improved band-gap voltage reference circuit embodiments, a current source is used; however, one embodiment of the current source uses current mirroring which is accomplished by applying the emitter-base voltage developed by forcing the bias current through a first, diode-connected transistor, to the base-emitter junction of a matched, second transistor.

In another embodiment of the current source for the above described embodiments of improved band-gap voltage reference circuits, current mirroring is accomplished as in the first current-source embodiment, but with the addition of a third common-collector buffer transistor connected to one of the emitter coupled transistors so as to form a negative feedback loop, with improved constancy of current mirroring ratio and improved output impedance. Thus, this band-gap voltage reference circuit incorporates a "Wilson Mirror" feature in combination with the other features of the circuit to provide the above described improvements to the band-gap voltage reference circuit.

In accordance with yet another embodiment of this invention, the improved band-gap voltage reference circuit generally described in the first embodiment is further improved by the insertion of a degeneration resistor in series with the emitter of each transistor of transistor pair wherein the base-emitter matching of said pair is critical.

The foregoing and other objects, features and advantages will be apparent from the following, more particular, description of the preferred embodiments of the invention, as illustrated in the accompanying drawings.

THE SPECIFICATION

Referring to FIG. 1, the fundamental operation of the inventive "band-gap" voltage reference circuit is described. A voltage source or "band-gap" reference $V_{BG}$ 27 equivalent to the difference in "band-gap" voltage between two transistors (not shown in this Figure but equivalent to transistors $Q_1$ and $Q_2$ of FIG. 3) operated at different emitter current densities, is connected in series with a differential-input, single-ended output, high gain operational amplifier 26. The operational amplifier 26 produces a voltage output 30 proportional, by a very high voltage gain ratio, to the positive difference between voltages applied between non-inverting (positive) input terminal 29 and inverting (negative) input terminal 28. Ideally, the output responds only to the differential voltage between terminals 29 and 28, regardless of the common-mode voltage from said terminals to any other reference voltage.

The voltage output 30 is "fed back" to the node or connection juncture of the "band-gap" reference 27 and a first end of resistor $R_1$. A second end of the resistor $R_1$ is connected to the input terminal 29 of the amplifier 26 and to both the base and collector terminals of a base-collector connected transistor $Q_{10}$. The emitter of the transistor $Q_{10}$ is connected to a first end of resistor $R_2$, while a second end of the resistor $R_2$ is connected to a reference ground. A "negative" feedback loop is shown in FIG. 1 and tends to reach an equilibrium wherein the voltage between input terminals 28 and 29 is forced esentially to zero. In such an equilibrium, the voltage across the resistor $R_1$ must necessarily equal the voltage across the bandgap reference 27, or a value $B_{BG}$. Since an idealized operational amplifier consumes no input current, the current through $R_1$ must then be $V_{BG}/R_1$, and said current must flow through $Q_{10}$ and $R_2$ to ground. Assuming a standardized voltage drop of $V_{BE}$ across the base-emitter junction of $Q_{10}$, equilibrium occurs when output 30 reaches a voltage $V_o$, which equals the sum of voltage drops across $R_2$, $Q_{10}$ and $R_1$, or $V_{BG}+V_{BE}+(V_{BG}/R_1)\ R_2$. $V_o$ may thus be seen to depend only on the precise $V_{BG}$, upon the precision ratio $R_2/R_1$, and $V_{BE}$. A current is forced through the resistors $R_1$ and $R_2$ by amplifier 26 (see FIG. 1) such that the temperature characteristic of $V_{BE}$ of the transistor $Q_{10}$ is cancelled. The cancellation voltage across the resistors $R_1$ and $R_2$ is set by the ratio of $R_2$ to $R_1$. The sum of the voltages across the resistor $R_1$, the transistor $Q_{10}$ and the resistor $R_2$ create a stable output voltage, $V_o$.

Figure 2:
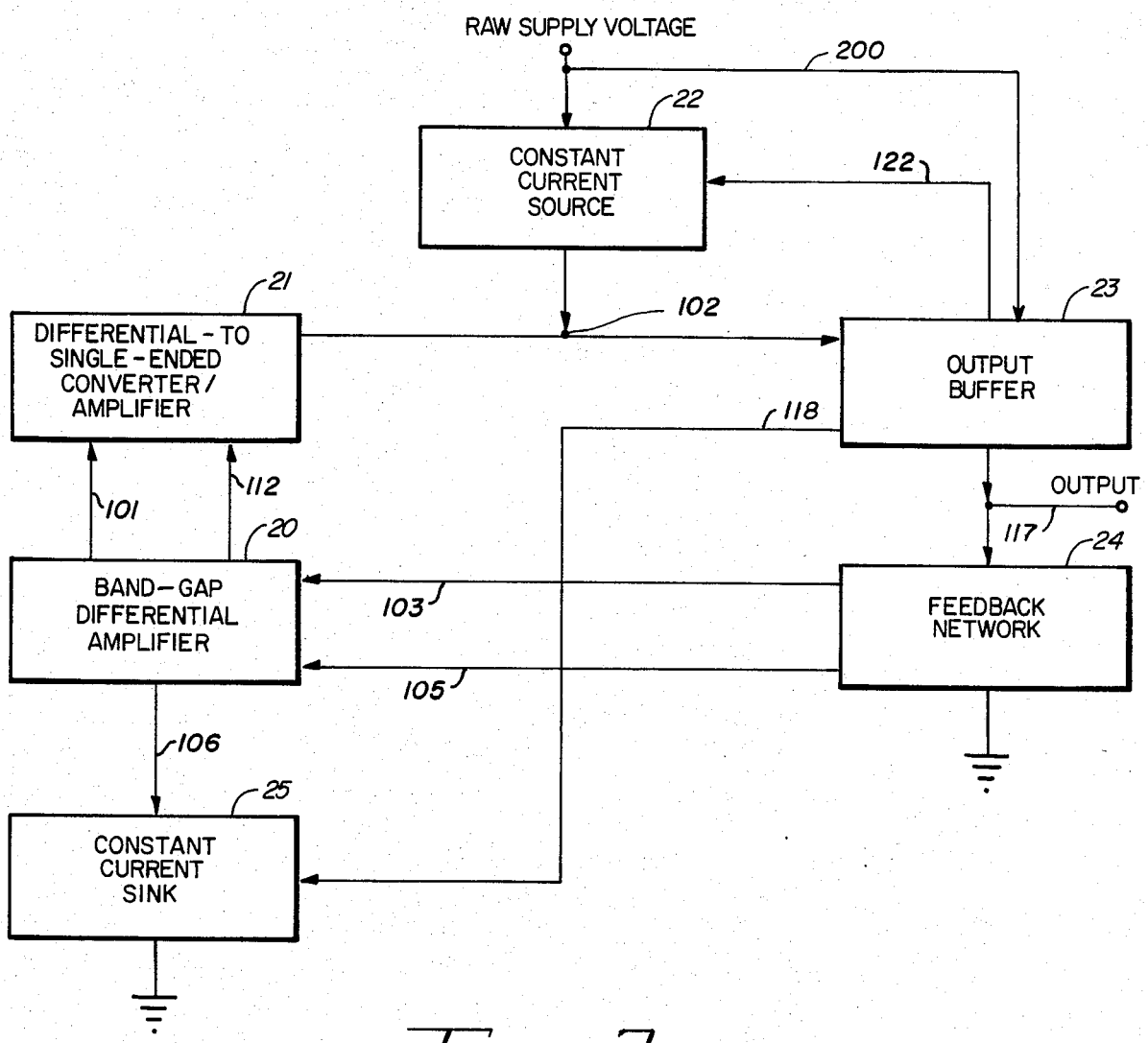
FIG. 2 is a block diagram of the functional elements embodied in the improved band-gap voltage reference circuit of this invention.

Referring to FIG. 2, a functional block diagram is shown wherein the principle delineated in FIG. 1 may be implemented. Band-gap differential amplifier 20 has input characteristics which approximate and combine the functions of the band-gap reference voltage source $V_{BG}$ 27, and inputs 28 and 29 of FIG. 1, such that overall equilibrium is reached when the voltage $V_{BG}$ 27 is impressed between inputs 103 and 105 (as shown in FIGS. 1 and 2).

A constant total current is drawn or sunk from the amplifier 20 by constant current sink 25, so that the sums of currents flowing in differential outputs 101 and 112 equals the constant sink current flowing through lead 106 of the amplifier 20.

The difference in currents flowing in the differential outputs 101 and 112 is converted by differential-to-single-ended converter/amplifier 21 into a magnified, single-ended current flowing into node 102.

Constant current source 22 supplies temperature-independent operating current to the converter/amplifier 21. Net changes in the output of the converter-/amplifier 21 are buffered by output buffer 23, and the resultant output of the output buffer 23 at output lead 117 drives the output load (not shown). The constant current source 22 and the constant current sink 25 shown in FIG. 2 are not specifically shown in FIG. 1 because they would be incorporated as part of the amplifier 26 shown in FIG. 1. Similarly, the converter/amplifier 21 and the output buffer 23 are incorporated as part of the amplifier 26 shown in FIG. 1. Feedback network 24 which is shown in FIG. 2 as being coupled to the band-gap differential amplifier 20 by means of the inputs 103 and 105 is equivalent to the feedback network comprising the feedback loop in FIG. 1 from the output 30 of the amplifier 26 and includes the resistors $R_1$ and $R_2$ and the intermediate base-collector (diode) connected transistor $Q_{10}$.

Voltage across the load (not shown, but would be impressed between the output 117 and ground) is reduced by a precise ratio, and temperature compensated, by means of the feedback network 24, the outputs of which drive the differential amplifier inputs 103 and 105. A single temperature-compensated bias current flows through lead 118 to set the current level of the current sink 25, and through lead 122 to set the current level of the current source 22. Negative feedback achieved by the feedback network 24 operates in a manner comparable to that described for FIG. 1, in that an equilibrium is reached at output 117 (see FIG. 2) wherein the voltage impressed by the feedback network 24 between the input terminals 103 and 105 equals the precise "band-gap" reference voltage $V_{BG}$ 27 (see FIG. 1), and hence the output voltage at the output 117 is precisely defined and substantially independent of temperature.

Figure 3:
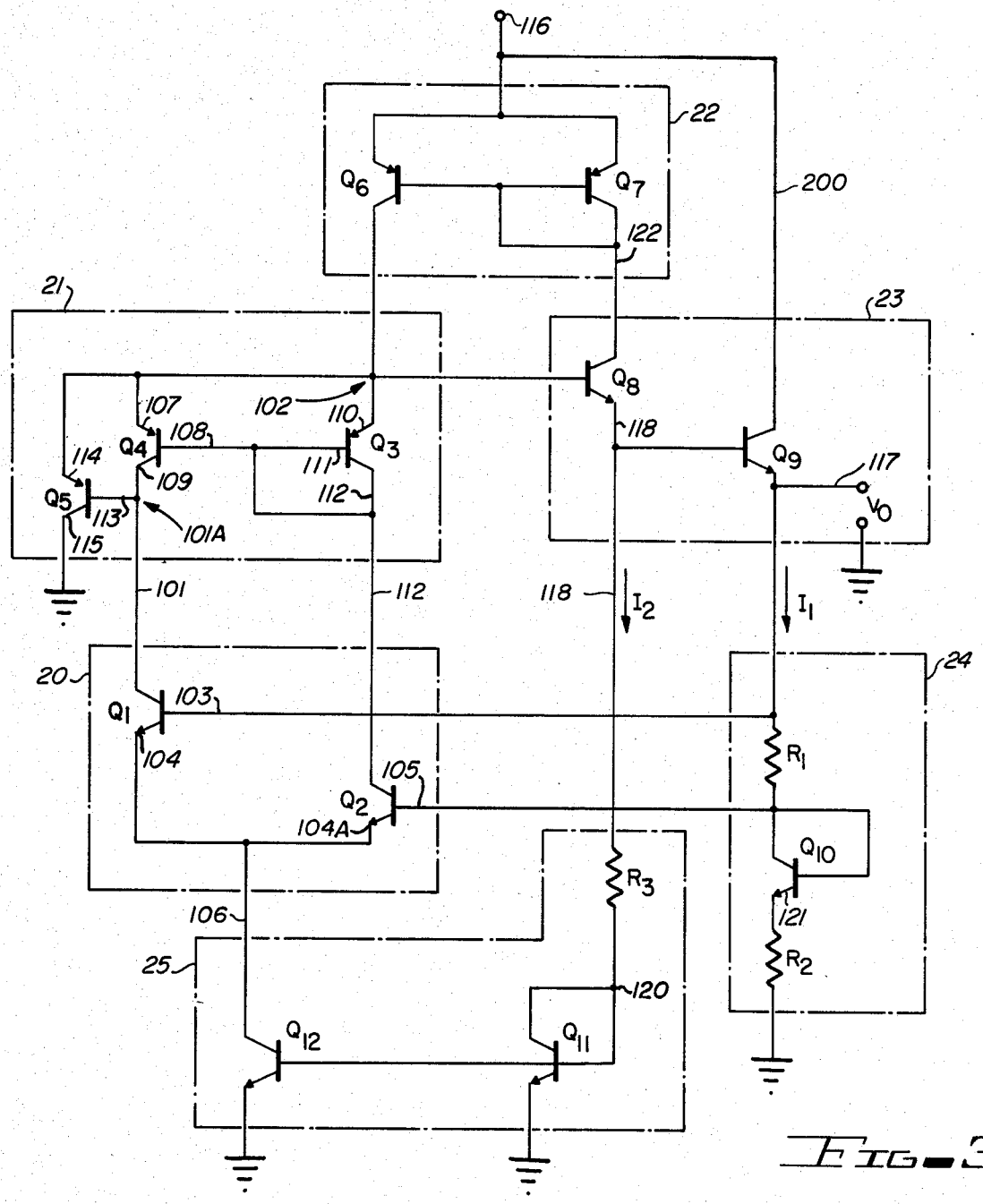
FIG. 3 is a schematic diagram of one embodiment of this invention with the boxes around certain circuit components being equivalent to the blocks of the block diagram of FIG. 2.

Referring to FIG. 3, a schematic diagram of one embodiment of the invention of FIG. 2 is shown, wherein dotted lines define boxes which define the boundaries of elements within the respective blocks shown in FIG. 2. The "band-gap" differential amplifier 20 is comprised of transistors $Q_1$ and $Q_2$, having emitters 104 and 104A coupled together and to the output 106 of the current sink 25, which is the collector of transistor $Q_{12}$. The collector of the transistor $Q_1$ is connected at node 101A to the collector 109 of transistor $Q_4$ and the base 113 of transistor $Q_5$. The collector 115 of the transistor $Q_5$ is connected to ground. The collector of the transistor $Q_2$ is connected to the collector 112 and to the base 111 of transistor $Q_3$ and to the base 108 of the transistor $Q_4$. The emitters 114 of the transistor $Q_5$, 107 of the transistor $Q_4$ and 110 of the transistor $Q_3$ are connected to node 102 (see also FIG. 2). Node 102 is also connected to the output of the current source 22, which is the lead line from the collector of transistor $Q_6$, and to the base of first buffer transistor $Q_8$ in the output buffer 23. The collector of the transistor $Q_8$ is connected by means of the control input 122 to the current source 22. The input lead 122 is connected to the base and collector of base-collector or diode connected transistor $Q_7$, and the base of transistor $Q_6$. The transistors $Q_6$ and $Q_7$ are interconnected as is shown in FIG. 3 to provide the constant current source 22 function of the block shown in FIG. 2 and in dotted form in FIG. 3. The emitters of the transistors $Q_6$ and $Q_7$ are connected together and are both connected to terminal 116, to which the raw positive supply voltage is applied.

The emitter of the first buffer transistor $Q_8$ is connected by means of the lead 118 to the base of second buffer transistor $Q_9$ within the output buffer box 23, and to a first end of resistor $R_3$ that is located within the constant current sink 25. A second end of $R_3$ is connected to node 120, which is connected to the collector and base of base-collector or diode connected transistor $Q_{11}$ and to the base of transistor $Q_{12}$. The transistors $Q_{11}$ and $Q_{12}$ are interconnected as shown to comprise the constant current sink 25.

The collector of the second buffer transistor $Q_9$ is connected to the raw positive supply voltage terminal 116 by means of lead 200 (see FIGS. 3 and 2). The emitter of the second buffer transistor $Q_9$ is connected to the output 117, to the base 103 of the transistor $Q_1$ located in the band-gap differential amplifier box 20 and to a first end of the resistor $R_1$. A second end of the resistor $R_1$ is connected to the base of the transistor $Q_2$ by means of the lead 105, and to both the collector and base of the base-collector connected transistor $Q_{10}$ which is part of the feedback network 24. The emitter 121 of the transistor $Q_{10}$ is connected to a first end of the resistor $R_2$. A second end of the resistor $R_2$ is connected to ground. The emitters of the transistors $Q_{12}$ and $Q_{11}$ which comprise the constant current sink 25 are also connected to ground.

FIG. 3 CIRCUIT OPERATION

The circuit described in FIG. 3 operates as follows:

In one preferred embodiment, the emitter 104 of the transistor $Q_1$ located in the band-gap differential amplifier 20 is of area x, and the emitter 104A of the transistor $Q_2$ is N times as large, or has an area N(x). The collector of the transistor $Q_{12}$ supplies a constant total current to the common connected emitters 104 and 104A of the transistors $Q_1$ and $Q_2$, respectively, and in equilibrium, half of the current flows in each said emitter. Because the emitter area ratio between the emitter 104A of the transistor $Q_2$ and the emitter 104 of the transistor $Q_1$ is N, under such equilibrium condition, a current density in the emitter 104 of the transistor $Q_1$ is produced which is N times as great as the current density in the emitter 104A of the transistor $Q_2$. Thus, the difference in band-gap voltage across the emitter-base junctions of the transistors $Q_1$ and $Q_2$ is precisely defined from a given total current from the collector of the transistor $Q_{12}$.

In this preferred embodiment, wherein equal currents are forced through unequal emitter areas, the equilibrium collector currents of the transistors $Q_1$ and $Q_2$ are equal to each other. Collector current from the transistor $Q_2$ is forced through the emitter-base junction of the diode-connected transistor $Q_3$, producing a predictable emitter-base voltage drop which, when impressed across the emitter-base junction of the transistor $Q_4$, causes an equal and opposite-polarity current to flow in the collector 109 of the transistor $Q_4$. Equilibrium is established, neglecting the comparatively small base current of the transistor $Q_5$, when the "reflected" current from the collector 109 of the transistor $Q_4$ equals the collector current of the transistor $Q_1$.

Transistor $Q_5$ amplifies the current variations appearing at node 101A and superimposes the amplified current upon the summed emitter currents of the transistor $Q_4$ and $Q_3$ at node 102. Because of the effective positive-feedback connection of the transistor $Q_5$, a very high impedance is presented at node 101A, and the effective differential to single-ended gain between differential amplifier inputs 103 and 105, and node 102, is high.

The base of the common-collector first buffer transistor $Q_8$ presents a high impedance to the node 102, permitting the differential-to-single-ended gain to remain high and to be relatively independent of the load impedance connected to the emitter of the second buffer transistor $Q_9$.

The output voltage, $V_o$ at the output 117, is applied through the negative feedback network 24, as heretofore described, to differential inputs 103 and 105, producing the desired feedback equilibrium and a scaled, temperature-compensated replica of the precise band-gap reference as output $V_o$.

Since a precise voltage reference $V_o$ appears at the output 117 at equilibrium, the voltage on the lead 118 is $V_{BE}$ higher than $V_o$, and has a temperature coefficient which varies as does $V_{BE}$. Thus, the $V_{BE}$ characteristics and temperature coefficient of the transistor $Q_{11}$ track those of the transistor $Q_9$, and the voltage impressed across the resistor $R_3$ is constant, independent of temperature, and set by the precise voltage $V_o$. $R_3$ is a low-temperature-coefficient resistor; hence current $I_2$ is precisely defined and virtually temperature-independent.

Current $I_2$ flowing through the lead 118 controls the current in the collector of the transistor $Q_{12}$ by the same "current mirror" mechanism as heretofore described for the transistors $Q_6$ and $Q_7$, except that the transistor $Q_{11}$'s emitter is made or fabricated to be twice the area of the transistor $Q_{12}$'s emitter. Thus, the sink current from the collector of the transistor $Q_{12}$ is equal to $I_2/2$.

Neglecting small base currents in the transistors $Q_8$ and $Q_9$, all of $I_2$ flows as collector current in the transistor $Q_8$, and is reflected by the current from the current source 22 (transistor $Q_6$) into the node 102. Since the sink current flowing through the differential amplifier and through the emitters 107 and 110 of the transistors $Q_4$ and $Q_3$, respectively, is $I_2/2$, there is an excess current at the node of 102 of $I_2/2$, which therefore flows through the emitter 114 of the transistor $Q_5$ to ground through collector 115 of the transistor $Q_5$. The biasing arrangement shown in FIGS. 3, 4 and 5 does not show initial "turn-on" means whereby it may be assured that the transistors $Q_6$, $Q_7$ and $Q_8$ initially conduct when power is first applied to the power supply terminal 116. Depending upon the integrated-circuit technology used to fabricate this invention, inherent very small leakage current in the collector of the transistor $Q_6$ or in the collector of the transistor $Q_8$ may suffice to assure "turn-on". However, a more positive or reliable turn-on may be achieved or enhanced by creating an artificial leakage current, such as by the use of a large, non-critical-valued resistor or other means generally known in the art, connected either from the collector of the transistor $Q_6$ to the power supply terminal 116, or from the collector of the transistor $Q_8$ to the ground. Thus, a single biasing circuit based upon the resistor $R_3$ and the voltage $V_o$ sets all of the operating currents except that flowing in the second output buffer transistor, $Q_9$, which output current varies with the load applied to the output 117. The precision temperature-independence of the internal biasing currents improves the overall temperature stability and total circuit power dissipation of the precision band-gap voltage reference.

ALTERNATIVE EMBODIMENTS

In a second alternative embodiment, the emitter areas of the transistors $Q_1$ and $Q_2$ are equal, but the emitter areas of the transistors $Q_3$ and $Q_4$ are unequal, having a ratio N. In this second embodiment, equilibrium of current is attained at the node 101A when the collector currents, and hence the emitter currents of the transistors $Q_1$ and $Q_2$ are forced through the feedback loop to be unequal, with a ratio N. Thus the same overall ratio 1:N of emitter current density is achieved in the second embodiment as is achieved in the first.

Figure 4:
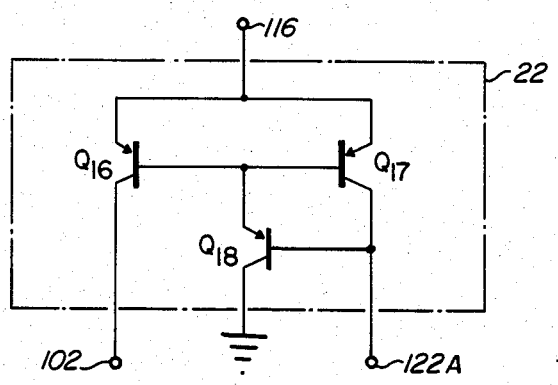
FIG. 4 is a schematic diagram of an alternative embodiment of the "current source" feature which can be used for the "current source" feature shown in FIG. 3.

In another or third embodiment, the two-transistor ($Q_6$ and $Q_7$) current source 22 heretofore described in FIG. 3 is replaced by a three-transistor "Wilson Mirror" type circuit configuration disclosed in FIG. 4. Transistors $Q_{18}$ and $Q_{17}$ form a negative-feedback amplifier in which equilibrium is attained when the collector current of the transistor $Q_{17}$ equals the current forced into the node 122A, that is connected to the lead 122 (see FIG. 3) between the constant current source 22 and the output buffer 23, less the negligible base current of the transistor $Q_{18}$. The base-emitter junctions of the transistors $Q_{16}$ and $Q_{17}$ are matched, so that the emitter-base voltage imposed in equilibrium by the feedback loop on the transistor $Q_{17}$, and which is just sufficient to produce a collector current equal and opposite to that forced into the node 122A, produces in the transistor $Q_{16}$ and identical collector current flowing out to the node 102 which is the same node 102 shown in FIG. 3. The current-reflection accuracy and output impedance of the "Wilson Mirror" type circuit configuration of FIG. 4 provides an improvement by approximately a factor equal to the current gain of the transistor $Q_{18}$, over the constant source or circuit configuration shown as 22 in FIG. 3.

Figure 5:
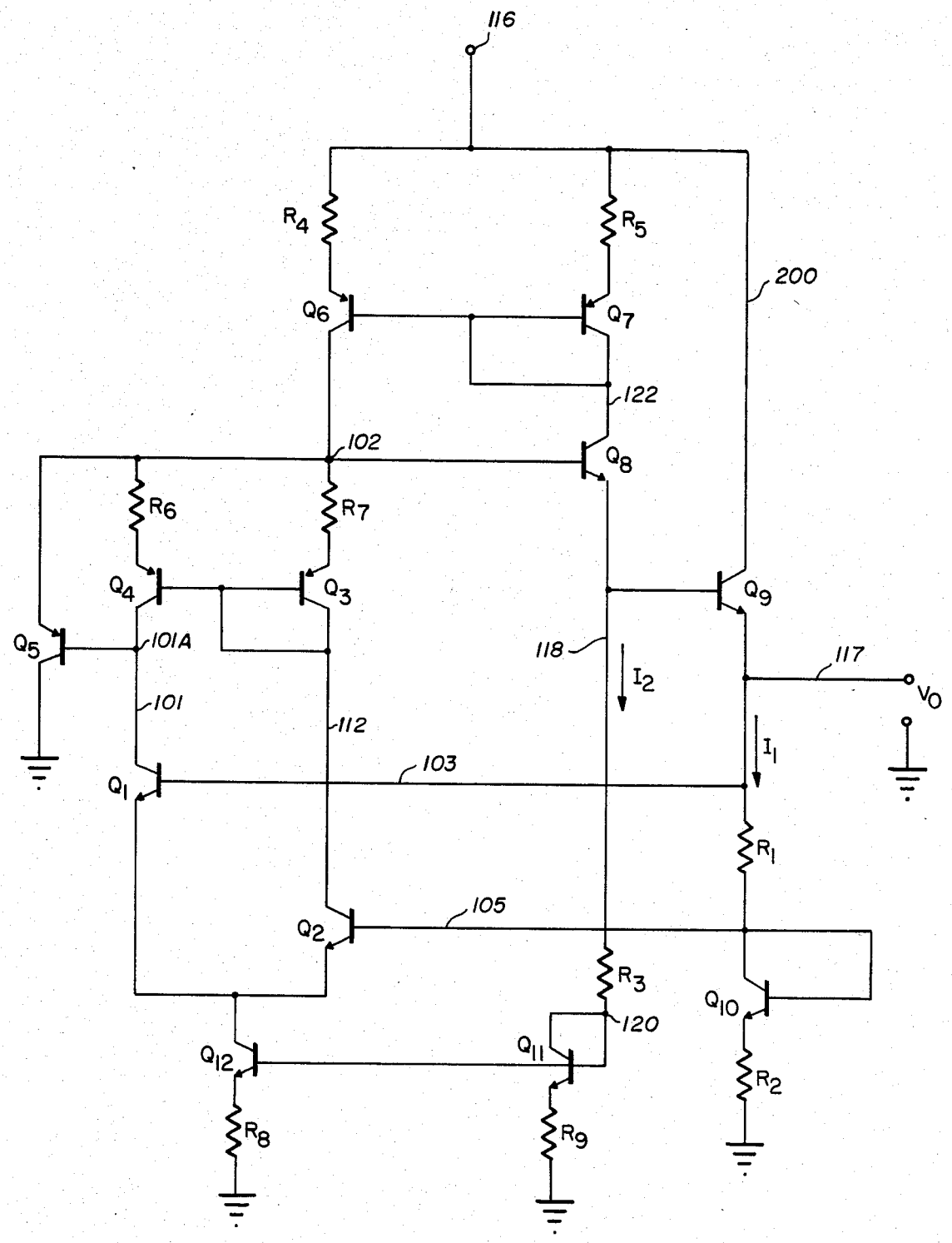
FIG. 5 is a schematic diagram of a second embodiment of this invenion, differing from FIG. 3 in the inclusion of degeneration resistors connected to certain transistor pairs.

In monolithic integrated circuit form, the matching between the emitters of the transistors $Q_6$ and $Q_7$, of the transistors $Q_{12}$ and $Q_{11}$, and of the transistors $Q_4$ and $Q_3$ is excellent; however, referring to FIG. 5, this emitter matching can be improved even further in yet another embodiment of the circuit configuration shown in FIG. 3 wherein degeneration resistors $R_4$, $R_5$, $R_8$, $R_9$, $R_6$ and $R_7$ are respectively interposed in series with the emitters of the transistors $Q_6$, $Q_7$, $Q_{12}$, $Q_{11}$, $Q_4$ and $Q_3$.

While the invention has been particularly shown and described with reference to the preferred embodiments thereof, it will be understood by those skilled in the art that the foregoing and other changes in form and details may be made therein without departing from the spirit and scope of the invention.

For example, in the illustrated embodiments NPN and PNP transistor devices are used as shown, however, these devices can be reversed, i.e., PNP devices substituted for NPN devices and vice-versa to accomplish the same circuit function, but this would produce a negative output voltage and would require a negative power supply voltage.

While the circuit configurations depicted in FIG. 3, 4 and 5, utilize a constant supply current, it is also possible to effectively operate the disclosed band-gap voltage reference circuit by using a variable supply current even though the performance level may be somewhat less. Thus, substantial performance improvements would be possible through the use of the high gain differential to single ended converter independent of the use of constant or variable current sources.

What is claimed is:

1. A band-gap voltage reference circuit comprising, in combination:

band-gap circuit means;

buffer means coupled to and responsive to said band-gap circuit means for producing a precise output voltage;

constant current supply means connected to said band-gap means and to said buffer means for causing said buffer means to produce said precise output voltage substantially independent of temperature, load and power supply variations; and feedback circuit means independent of said constant current supply means coupled to said band-gap circuit means and said buffer means for differentially applying to said band-gap circuit means a portion of said output voltage.

2. A band-gap voltage reference circuit in accordance with claim 1 wherein said constant current supply means comprises current mirror means for forcing a constant current through said band-gap circuit means.

3. A band-gap voltage reference circuit in accordance with claim 2 wherein said current mirror means comprises current sinking means for sinking current from said band-gap circuit means.

4. A band-gap voltage reference circuit in accordance with claim 3 wherein said current sinking means comprising a pair of NPN transistors having their bases connected together, one of said pair of NPN transistors having a collector connected to said band-gap circuit means to sink current therefrom.

5. A band-gap voltage reference circuit in accordance with claim 4 wherein the other of said pair of NPN transistors being base-collector connected and having the emitter area a fixed multiple ratio to the emitter area of said one of said pair of NPN transistors.

6. A band-gap voltage reference circuit in accordance with claim 4 wherein said emitter area of the other of said pair of NPN transistors being twice the emitter area of the one of said pair of NPN transistors.

7. A band-gap voltage reference circuit in accordance with claim 1 including biasing means for providing a constant control current to said constant current supply means which is independent of temperature, load and power supply variations.

8. A band-gap voltage reference circuit in accordance with claim 7 wherein said biasing means comprising transistor means and resistor means coupled to said transistor means which together with said transistor means provide a voltage across said resistor means which is equal to an output voltage generated by said gand-gap voltage reference circuit.

9. A band-gap voltage reference circuit in accordance with claim 8 wherein said transistor means comprising output buffer transistor means having a base-emitter temperature coefficient which tracks the temperature coefficient of the input to the constant current supply means for maintaining said constant control current independent of temperature, load and power supply variations.

10. A voltage reference circuit comprising, in combination:

a differential amplifier having a differential input voltage and a first and a second transistor, means for precisely offsetting the differential input voltage of said differential amplifier by a voltage determined by the "band-gap" difference between said first transistor's emitter-base voltage and said second transistor's emitter-base voltage, said first and second transistors having means for providing different emitter current densities, means coupled to said differential amplifier for sinking a temperature-independent, constant current from said differential amplifier, means coupled to said differential amplifier for the conversion of differential output current from said differential amplifier into single-ended output current, means coupled to said conversion means to supply a temperature-independent bias current to said conversion means, buffering means coupled to the output of said conversion means which is independent of any load applied to said buffering means, said buffering means having an output voltage, and feedback means coupled to said buffering means for precisely feeding back a portion of said output voltage to said differential amplifier, said converting means comprises:

mirroring means for reflecting an opposite-polarity replica of an output current generated by said differential amplifier, a first current summing node connected to said differential amplifier and the opposite-polarity replica of said output current therefrom, said first current summing node being also connected to the collector of said second transistor of said differential amplifier, a third transistor coupled to said mirroring means, said third transistor connected to said first current summing node, a second current summing node, the emitter of said third transistor is connected to said second current summing node, said second current summing node is also connected to said mirroring means whereby the total common-node collector output current of both said first and second differential amplifier transistors flows through said second current summing node, said third transistor providing substantial current amplification from said first node to said second node, and temperature-independent constant-current source means connected to said second current summing node to supply the total current demanded by said third transistor and said mirroring means.

11. A voltage reference circuit in accordance with claim 10 wherein said means for providing different emitter current densities in said first and second transistors of said differential amplifier comprises:

an emitter area of said first transistor defined as "x", an emitter area of said second transistor being a multiple N (x) of the emitter area of said first transistor, said feedback means having means coupled to said first and second transistors of said differential amplifier for forcing an equilibrium of the output currents of the collectors of said first and second transistors of said differential amplifier.

12. A voltage reference circuit comprising, in combination:

a differential amplifier having a differential input voltage and a first and a second transistor, means for precisely offsetting the differential input voltage of said differential amplifier by a voltage determined by the "band-gap" difference between said first transistor's emitter-base voltage and said second transistor's emitter-base voltage, said first and second transistors having means for providing different emitter current densities, means coupled to said differential amplifier for sinking a temperature-independent, constant current from said differential amplifier, means coupled to said differential amplifier for the conversion of differential output current from said differential amplifier into single-ended output current, means coupled to said conversion means to supply a temperature-independent bias current to said conversion means, buffering means coupled to the output of said conversion means which is independent of any load applied to said buffering means, said buffering means having an output voltage, feedback means coupled to said buffering means for precisely feeding back a portion of said output voltage to said differential amplifier, constant current source means coupled to said conversion means, degeneration resistor means coupled to each of said sinking means, conversion means, and constant current source means for providing improved matching characteristics for each of said sinking means, conversion means and constant current source means.

13. A voltage reference circuit in accordance with claim 10 or 11 including a common biasing circuit, said temperature-independent bias current means and said sinking means being connected to said common biasing circuit, said common biasing circuit having means for permitting said temperature-independent bias current means and said sinking means to track each other with respect to their current values.

14. A voltage reference circuit in accordance with claim 10 or 11 including constant current source means coupled to said conversion means, said constant current source means having a "Wilson Mirror" circuit configuration.

15. A voltage reference circuit in accordance with claim 10 or 11 wherein said means for providing different emitter current densities in said first and second transistors of said differential amplifier comprises:

means for applying a different current to each of said first and second transistors having the same area emitter regions, said differential output current of said differential amplifier being unequal output currents, said conversion means having means responsive to said unequal output currents of said differential amplifier to produce an equilibrium of current in said conversion means, said feedback means having means coupled to said first and second transistors of said differential amplifier for forcing said equilibrium of current in said conversion means.

16. A voltage reference circuit comprising, in combination:

a differential amplifier having a differential input voltage and a first and a second transistor, means for precisely offsetting the differential input voltage of said differential amplifier by a voltage determined by the "band-gap" difference between said first transistor's emitter-base voltage and said second transistor's emitter-base voltage, said first and second transistors having means for providing different emitter current densities, means coupled to said differential amplifier for sinking a temperature-independent, constant current from said differential amplifier, means coupled to said differential amplifier for the conversion of differential output current from said differential amplifier into single-ended output current, means coupled to said conversion means to supply a temperature-independent bias current to said conversion means, buffering means coupled to the output of said conversion means which is independent of any load applied to said buffering means, said buffering means having an output voltage, feedback means coupled to said buffering means for precisely feeding back a portion of said output voltage to said differential amplifier, including a common biasing circuit, said temperature-independent bias current means and said shrinking means being connected to said common biasing circuit, said common biasing circuit having means for permitting said temperature-independent bias current means and said sinking means to track each other with respect to their current values, said means of said common biasing circuit comprises:

means for providing a source of bias voltage derived from said output output voltage and offset therefrom by a voltage drop across said buffering means, an input to said sinking means, means coupled to said input to said sinking means for providing an offset voltage equivalent to the voltage drop across said buffering means, resistor means interposed between said means for providing a source of bias voltage and said input to said sinking means for providing a constant current to said sinking means, and means coupled to said resistor means for biasing both said sinking means and said means coupled to said conversion means to supply a temperature-independent bias current to said conversion means.

17. A method for producing a precise reference voltage independent of temperature, load and power supply variations comprising the steps of:

providing a band-gap circuit;

providing a buffer circuit for producing a precise output voltage in response to a signal from said band-gap circuit;

connecting a constant current supply to said band-gap circuit and said buffer circuit for causing said buffer circuit to produce said precise output voltage substantially independent of temperature, load and power supply variations; and coupling a feedback circuit independent of said constant current supply to said band-gap circuit for differentially applying to said band-gap circuit a portion of said output voltage.

18. A method in accordance with claim 17 including the steps of providing unequal current densities within said band-gap circuit by forcing equal currents through transistor devices of said band-gap circuit having unequal emitter areas to obtain a precise band-gap voltage reference.

19. A method in accordance with claim 17 including the step of providing unequal current densities within said band-gap circuit by forcing unequal currents through transistor devices of said band-gap circuit having equal emitter areas to obtain a precise band-gap voltage reference.

20. A band-gap voltage reference circuit comprising, in combination:

band-gap circuit means having differential output currents;

high-gain, differential-to-single-ended conversion means coupled to said band-gap circuit means for producing a single-ended current from said differential output current; and buffer means coupled to said conversion means for providing a precise output voltage; and constant current supply means coupled to said buffer means, to said conversion means and to said band-gap circuit means, said constant current supply means causing said precise output voltage to be substantially independent of temperature, load and power supply variations.

21. A band-gap voltage reference circuit in accordance with claim 20 wherein said high-gain, differential-to-single-ended conversion means comprises:

a current mirror means for providing a current opposite in polarity and proportional to one of said differential output currents of said band-gap circuit means;

current amplification means coupled to said current mirror means for amplifying the algebraic sum of said current provided by said current mirror means and a second one of said differential output currents of said band-gap circuit means, said current amplification means having a single-ended output current; and means for combining and augmenting said single-ended output current of said current amplification means with the totality of current flowing in said current mirror which includes said current opposite in polarity and proportional to said one of said different output currents and said one of said differential output currents.

22. A band-gap voltage reference circuit in accordance with claim 20 wherein said high-gain, differential-to-single-ended conversion means comprises:

first and second inputs;

a first PNP transistor having the base and collector connected to said first input and the emitter connected to an output;

a second PNP transistor having the base connected to said first input, the emitter connected to said output, and the collector connected to said second input; and a third PNP transistor having the base connected to said second input and to said collector of said second PNP transistor, the emitter connected to said output, and the collector connected to ground.

23. A band-gap voltage reference circuit in accordance with claim 20 wherein said constant current supply means comprises current mirror means for forcing a constant current through said band-gap circuit means.

24. A band-gap voltage reference circuit in accordance with claim 23 wherein said current mirror means comprises current sinking means for sinking current from said band-gap curcuit means.

25. A band-gap voltage reference circuit in accordance with claim 24 wherein said current sinking means comprising a pair of NPN transistors having their bases connected together, one of said pair of NPN transistors having a collector connected to said band-gap circuit means to sink current therefrom.

26. A band-gap voltage reference circuit in accordance with claim 25 wherein the other of said pair of NPN transistor being base-collector connected and having the emitter area a fixed mulitple ratio to the emitter area of said one of said pair of NPN transistors.

27. A band-gap voltage reference circuit in accordance with claim 25 wherein said emitter area of the other of said pair of NPN transistors being twice the emitter area of the one of said pair of NPN transistors.

28. A band-gap voltage reference circuit in accordance with claim 20 including biasing means for providing a constant control current to said constant current supply means which is independent of temperature, load and power supply variations.

29. A band-gap voltage reference circuit in accordance with claim 28 wherein said biasing means comprising transistor means and resistor means coupled to said transistor means which together with said transistor means provide a voltage across said resistor means which is equal to an output voltage generated by said band-gap voltage reference circuit.

30. A band-gap voltage reference circuit in accordance with claim 29 wherein said transistor means comprising output buffer transistor means having a base-emitter temperature coefficient which tracks the temperature coefficient of the input to the constant current supply means for maintaining said constant control current independent of temperature, load and power supply variations.

31. An amplifier circuit comprising, in combination, differential amplifier means, having differential voltage inputs, for providing differential current outputs;

high-gain, differential to single-ended conversion means coupled to said differential current outputs of said differential amplifier means for producing a single-ended output current from said differential output currents of said differential amplifier, comprising:

current mirror means for providing a current opposite in polarity and proportional to one of said differential output currents of said differential amplifiers;

current amplification means coupled to said current mirror means for amplifying the the algebraic sum of said current provided by said current mirror means, and a second one of said differential output currents of said differential amplifier means, said current amplification means having a single-ended output current; and means for combining and augmenting said single-ended output current of said current amplification means with the totality of current flowing in said current mirror means which includes said current opposite in polarity and proportional to said one of said differential output currents.

32. An amplifier circuit comprising, in combination differential amplifier-means, having differential voltage inputs, for providing differential current outuputs;

high-gain, differential to single-ended conversion means coupled to said differential current outputs of said differential amplifier means for producing a single-ended output current from said differential output currents of said differential amplifier, comprising:

current mirror means for providing a current opposite in polarity and proportional to one of said differential output currents of said differential amplifiers;

current amplification means coupled to said current mirror means for amplifying the algebraic sum of said current provided by said current mirror means, and a second one of said differential output currents of said differential amplifier means, said current amplification means having a single-ended output current;

means for combining and augmenting said single-ended output current of said current amplification means with the totality of current flowing in said current mirror means which includes said current opposite in polarity and proportional to said one of said differential output currents;

said high-gain, differential-to-single-ended conversion means further including;

a first and second inputs;

PNP first transistor having the base and collector connected to said first input and the emitter connected to an output;

a PNP second transistor having the base connected to said first input, the emitter connected to said output, and the collector connected to said second input; and a PNP third transistor having the base connected to said second input and to said collector of said PNP second transistor, the emitter connected to said output, and the collector connected to ground.

33. A band-gap voltage reference circuit comprising, in combination:

differential amplifier means for providing differential output currents, said differential amplifier means comprising:

an NPN first band-gap transistor, and an NPN second band-gap transistor having its emitter connected to the emitter of said NPN first band-gap transistor;

high gain, differential-to-single-ended conversion means coupled to said differential amplifier means for producing a single-ended current from said differential output currents, said conversion means comprising:

a PNP third transistor having its collector and base connected to the collector of said NPN second band-gap transistor, a PNP fourth transistor having its base connected to the collector of said NPN second band-gap transistor and to the base and collector of said PNP third transistor, having its collector connected to the collector of said NPN first band-gap transistor, and having its emitter connected to the emitter of said PNP third transistor, and a PNP fifth transistor having its base connected to the collectors of said PNP fourth transistor and first PNP band-gap transistor, having its collector connected to ground, and having its emitter connected to the emitters of said PNP third and fourth transistors, constant current supply means coupled to said diffential amplifier means and to said conversion means, said constant current supply means comprising a PNP sixth transistor having its collector connected to the emitters of said PNP third, fourth and fifth transistors and having its emitter connected to a positive supply terminal, and a PNP seventh transistor having its base and collector connected to the base of said PNP sixth transistor, and having its emitter connected to the emitter of said PNP sixth transistor and to a positive supply terminal, buffering means coupled to the output of said conversion means for providing a load impedance to said conversion means comprising:

an NPN eighth transistor having its collector connected to the collector and base of said PNP seventh transistor, and to the base of said PNP sixth transistor, and having its base connected to the emitters of said PNP third, fourth and fifth transistors and to the collector of said PNP sixth transistor, and an NPN ninth transistor having its collector connected to siad positive supply terminal, having its base connected to the emitter of said NPN eighth transistor, and having its emitter connected to the base of said first NPN band-gap transistor and to an output terminal, a feedback network coupled to said buffering means comprising a first resistor, having a first end connected to said emitter of said NPN ninth transistor, to said base of said first band-gap NPN transistor and to said output terminal, and a second end of said first resistor connected to the base of said second band-gap NPN transistor, an NPN tenth transistor having its base and collector connected to said second end of said first resistor and to said base of said second band-gap NPN transistor, a second resistor, having a first end connected to the emitter of said NPN tenth transistor, and a second end connected to ground;

current sinking means coupled to said differential amplifier means for sinking current from said differential amplifier means comprising a third resistor, having a first end connected to said emitter of said NPN eight transistor of said buffering means and to said base of said NPN ninth transistor of said buffering means, an NPN eleventh transistor having its base and collector connected to a second end of said third resistor, and having its emitter connected to ground, and a NPN twelfth transistor having its base connected to said base and collector of said NPN eleventh transistor, and to said second end of said third reistor, having its emitter connected to ground, and having its collector connected to said emitters of said NPN first and second band-gap transistors.

34. A band-gap voltage reference circuit in accordance with claim 33 including means for establishing unequal current densities in the emitters of said first and second NPN band-gap transistors comprising:

the emitter of said first NPN band-gap transistor having an area "x", the emitter of said second NPN band-gap transistor having a different area "N(x)" where N is a value different from one, and the emitters of said PNP third and fourth transistors having areas equal to each other.

35. A band-gap voltage reference circuit in accordance with claim 33 including means for establishing unequal current densities in the emitters of said first and second NPN band-gap transistors comprising:

the emitters of said first and second NPN band-gap transistors having areas equal to each other, the emitter of said PNP transistor having an area "y", and the emitter of said PNP fourth transistor having a different area "N(y)" where N is a value different then one.

36. An amplifier circuit comprising, in combination:

differential amplifier means for providing differential output currents, said differential amplifier means comprising:

an NPN first transistor, and an NPN second transistor having its emitter connected to the emitter of said NPN first transistor;

high gain differential-to-single-ended conversion means coupled to said differential amplifier means for providing a single-ended current from said differential output currents, said conversion means comprising:

a PNP third transistor having its collector and its base connected to the collector of said NPN second transistor, a PNP fourth transistor having its base connected to the collector of said NPN second transistor and to the base and the collector of said PNP third transistor, having its collector connected to the collector of said NPN first transistor, and having its emitter connected to the emitter of said PNP third transistor; and a fifth PNP transistor having its base connected to the collectors of said PNP fourth and NPN first transistors, having its collector connected to ground, and having its emitter connected to the emitters of said PNP third and fourth transistors.

* * * * *

UNITED STATES PATENT AND TRADEMARK OFFICE

CERTIFICATE OF CORRECTION

PATENT NO. : 4,525,663

DATED : June 25, 1985

INVENTOR(S) : Paul M. Henry

It is certified that error appears in the above-identified patent and that said Letters Patent are hereby corrected as shown below:

Column 9, Claim 8, line 62, please change "gand" to --band--.

Column 12, Claim 16, line 30, please change "shrinking" to --sinking--.

Signed and Sealed this

*Eighth* Day of *October 1985*

[SEAL]

*Attest:*

DONALD J. QUIGG

*Attesting Officer*

*Commissioner of Patents and Trademarks—Designate*